US005720527A

United States Patent [19]

Sartaine et al.

[11] Patent Number: 5,720,527

[45] Date of Patent: Feb. 24, 1998

[54] CONTINUOUS HIGHWALL MINING MACHINE WITH ARMLESS CONVEYOR

[75] Inventors: John J. Sartaine, Russell; John A. Baird, Jr., Flatwoods; Ian T. Carr, Ashland, all of Ky.; Jon C. Blackstock, Ironton, Ohio

[73] Assignee: Mining Technologies, Inc., Ashland, Ky.

[21] Appl. No.: 553,693

[22] PCT Filed: Oct. 18, 1995

[86] PCT No.: PCT/US95/13105

§ 371 Date: Nov. 20, 1995

§ 102(e) Date: Nov. 20, 1995

[87] PCT Pub. No.: WO96/12869

PCT Pub. Date: May 2, 1996

Related U.S. Application Data

[63] Continuation-in-part of Ser. No. 328,642, Oct. 25, 1994, Pat. No. 5,522,647.

[51] Int. Cl.[6] ..... F21C 35/20

[52] U.S. Cl. ..... 299/64; 198/516

[58] Field of Search ..... 299/64; 198/512, 198/514, 515, 516

[56] References Cited

U.S. PATENT DOCUMENTS

| | | | |
|---|---|---|---|
| 2,263,458 | 11/1941 | Gellatly | 198/728 |
| 2,724,517 | 11/1955 | Lewis | 414/523 |
| 2,798,706 | 7/1957 | Silver | 299/64 X |
| 3,154,190 | 10/1964 | Gonski | 198/570 |
| 3,190,697 | 6/1965 | Gonski | 299/64 |
| 3,516,712 | 6/1970 | Bennett et al. | 299/64 |
| 3,651,923 | 3/1972 | Anderson et al. | 198/550.12 |
| 3,873,157 | 3/1975 | Stoltefuss et al. | 299/31 |
| 4,133,582 | 1/1979 | Kogelmann | 299/64 |
| 4,588,071 | 5/1986 | Kleibohmer | 198/516 |
| 5,112,111 | 5/1992 | Addington et al. | 299/18 |
| 5,261,729 | 11/1993 | Addington et al. | 299/64 |
| 5,522,647 | 6/1996 | Sartaine et al. | 299/64 |

FOREIGN PATENT DOCUMENTS

| | | | |
|---|---|---|---|
| 43812 | 1/1982 | European Pat. Off. | 299/64 |
| 1964272 | 7/1968 | Germany . | |
| 2449459 | 4/1976 | Germany . | |
| 2827767 | 1/1980 | Germany . | |
| 977944 | 12/1964 | United Kingdom . | |

*Primary Examiner*—David J. Bagnell
*Attorney, Agent, or Firm*—King & Schickli

[57] ABSTRACT

A continuous highwall mining machine (10) includes a frame (12) and a ground engaging loading shovel (32) that is mounted to extend forwardly from the frame. A cutter (16) for winning aggregate material is mounted to the frame (12) so as to extend above and forwardly of the loading shovel (32). An armless conveyor system (40) conveys aggregate material won from the mineral seam. The armless conveyor system includes twin chains having a forked section (44) at the forwardmost end carried on the loading shovel (32) and an uninterrupted humpless and dipless path extending rearwardly to a discharge end.

20 Claims, 4 Drawing Sheets

CONTINUOUS HIGHWALL MINING MACHINE WITH ARMLESS CONVEYOR

This is a continuation-in-part of U.S. patent application Ser. No. 08/328,642 filed on Oct. 25, 1994, now U.S. Pat. No. 5,522,647 entitled "Continuous Highwall Mining Machine With Armless Conveyor."

TECHNICAL FIELD

The present invention relates generally to the art of mining, and more particularly, to an improved mining machine adapted for utilization in a mining system for winning aggregate material such as coal from a mineral seam.

BACKGROUND OF THE INVENTION

A highwall mining system has recently been developed by Mining Technologies, Inc. and is generally described in, for example, U.S. Pat. Nos. 5,112,111 and 5,261,729 to Addington et al. Highwall mining is particularly useful where the coal seam is located at a significant depth below the surface and the amount of overburden that must be removed to reach the coal makes further strip mining economically unfeasible.

The highwall mining system includes a miner or mining machine for cutting material from the seam and a conveyor for conveying the won aggregate material from the mining machine for recovery. The conveyor is formed by a series of individual conveyor units that are coupled or interconnected in series so as to form a train. The last unit of the conveyor train is supported on a launch vehicle anchored to the bench outside the mine seam, The launch vehicle includes an underlying belly conveyor that receives aggregate material from the last unit of the conveyor train and delivers this material to a discharge conveyor.

In the past, the mining machine utilized in the highwall mining system has comprised a continuous miner of conventional design. Such a miner incorporates a gathering head including mechanically driven gathering arms or centripetal/centrifugal loading arms that feed the coal rearwardly to a chain conveyor. Such a gathering arm mechanism has a number of distinct disadvantages.

First, it should be appreciated that each of the components necessary to operate and drive the gathering arms consumes vertical space and effectively functions to increase the height profile of the mining machine thereby limiting its operational capabilities to relatively thick seams where the necessary clearance is provided. Second, the gathering arms require their own drive motor, gearing and related electrical devices that significantly increase costs associated with both production and maintenance.

Third, due to their location (i.e. in a lowermost position beneath the head that cuts the coal from the seam and adjacent to the ground or floor), the gathering arm gear cases are susceptible to infiltration by water and mud/sand/grit resulting in contamination and damage. This leads to significant downtime for repairs. Fourth, these components also consume a significant amount of the available horizontal and vertical space between the pan of the gathering head and the boom of the overlying mill or drum-type cutting head. In fact, the drive mechanisms for the gathering arms serve to create a narrow throat or bottleneck that disadvantageously slows conveyance of won aggregate material and thereby limits conveyor system through-put or carrying capacity.

Fifth, because of the space required to accommodate the gathering arm drive mechanisms, the reversing roller of the conveyor system must be positioned relatively rearwardly. Thus, the distance that the cut aggregate material must be moved for deposit into the conveyor is increased. This requires the provision of greater "storage capacity" in the gathering pan to accommodate the aggregate material during transfer and necessitates additional work from the arms resulting in a broken product and the production of unwanted fines and a loss of production. Sixth, because of the expense of providing a drive mechanism for the gathering arms, the conveyor is normally driven by the same drive. Thus, the loaded conveyor is pushed from the front end (i.e. the load is conveyed by the slack side of the chain). This reduces conveyor efficiency and, unfortunately adversely affects overall conveyor service life.

The chain conveyor incorporated into a continuous miner of conventional design also suffers from a number of distinct disadvantages that adversely effect its operating efficiency. More particularly, such a chain conveyor typically follows a pathway incorporating humps and dips that extend over and under various components of the continuous miner. Each hump and dip, unfortunately, interferes with and thereby increases the resistance to the flow of aggregate material thereby adversely effecting conveyor efficiency and throughput capacity. Further, the various components of the continuous miner surrounding the chain conveyor produce constrictions and bottlenecks that further limit efficient operation of the conveyor system and in some cases drastically reduce throughput capacity. Recognizing these shortcomings, a need is identified for a mining machine of improved design particularly adapted for utilization in a highwall mining system.

SUMMARY OF THE INVENTION

Accordingly, it is a primary object of the present invention to provide an improved mining machine of simple, inexpensive and reliable design that provides enhanced aggregate material cutting and carrying capacity in conjunction with significantly increased operating efficiency and lower operating costs.

Another object of the invention is to provide a mining machine that eliminates the need for the gathering arm mechanism and thereby provides the attendant advantages of a lower profile to allow operation in thinner seams and the elimination of constrictions to the conveyance path so as to allow completely efficient conveyance of the aggregate material being won from the mineral seam. Further, the resulting space savings allow more room for the utilization of larger cutter head motors and gear cases so that more horsepower may be provided for the cutting of coal as compared with conventional mining machines of similar height dimension.

Yet another object of the present invention is to provide a mining machine for continuous mining of a mineral seam incorporating a loading shovel including a scoop with sidewalls in conjunction with an armless conveying system comprising a twin chain conveyor for conveying aggregate material along a pathway of substantially constant acclivity from the loading shovel to the rear of the mining machine. Advantageously, through the elimination of the gathering arm mechanism and related components it is possible to save space and thereby allow both wider and deeper conveyor flights to be utilized. Further, the humpless and dipless conveyor pathway minimizes resistance to the flow of aggregate material. As a result, the flow volume of the conveying system may be markedly enhanced to match the increased coal cutting capacity of the machine as just described so that the operator receives the full benefit of increased production provided by this innovative design.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved mining machine is provided for the continuous highwall mining of a mineral seam. The mining machine includes a frame having a front end and rear end. A loading shovel is mounted to the front end of the frame. The loading shovel includes a scoop with a front lip and sidewalls. A rotating drum with picks is provided for winning aggregate material from the mineral seam. Preferably, the drum is carried on a pivotable boom mounted on the frame.

The mining machine also includes an armless mechanism for conveying aggregate material won from the mineral seam rearwardly from the loading shovel to the rear end of the frame. Further, the mining machine preferably includes a propelling mechanism and may, in fact, be self-propelled by means of a pair of traction motors operatively connected to a pair of crawler assemblies, one crawler assembly operatively mounted to each side of the frame. Accordingly, it should be appreciated that the mining machine may make use of a conventional drive mechanism well known in the art.

Advantageously, the mining machine of the present invention provides a number of distinctive advantages over conventional continuous miners. The mining machine incorporates a twin chain flight conveyor driven by a single drive motor. The twin chain flight conveyor follows a substantially constant acclivity from the forwardmost end to the rearwardmost end. More specifically, the conveyor follows an inclination angle between 3°–7° and more preferably substantially 5°. Accordingly, all conveyor dips and humps that have a tendency to increase resistance to flow are eliminated. Hence, throughput capacity is maximized.

The receiving or forwardmost end of the twin chain conveyor includes a forked section that has a deviation-from-centerline angle of between substantially 1°–60° and more preferably 20°–40°. As a result, the individual legs of the forked section of the conveyor extend to within five and, more preferably, substantially three inches of the front lip and sidewalls of the loading shovel at the left and right front corners thereof. Further, the front lip includes an aggregate material carrying surface that rises seven inches and extends at a tangent to the reversing roller of the conveyor adjacent thereto. This effectively serves to feed the aggregate material directly into the conveyor.

This forked construction just described increases conveying efficiency by minimizing the residence time of aggregate material in the loading shovel. Further, prompt conveyance of the aggregate material resulting from the relatively forward position of the receiving end of the conveyor has the additional benefit of reducing the aggregate material storage volume required to be designed into the loading shovel since the material is rapidly removed by the twin chain conveyor and not allowed to accumulate. Accordingly, a lower overall profile may be provided to the shovel. Importantly, this allows for operation in relatively thinner seams.

It should further be appreciated that the drive motor for the twin chain conveyor is located on the frame of the mining machine not on the loading shovel. This positioning of the drive components reduces the overall weight of the loading shovel thereby reducing the frictional load of the shovel against the mine floor as the mining machine sumps forward. Thus, sumping force requirements are reduced and operating efficiency is improved.

The elimination of the drive components from the loading shovel also serves to create more free space for the rearward passage of the aggregate material. In fact, the individual flights of the twin chain conveyor may be made both wider and longer thereby significantly increasing conveyor capacity. More specifically, the flights carried on each conveyor chain may have a width W. Accordingly, the twin chain flight conveyor provides a flight width conveying capacity of (w+w) along the forked section of the conveyor. Rearwardly of the forked section, the conveyor chains run parallel and the flights on the two chains are interdigitated (i.e. overlap). Thus, the overall width of the conveyor is less than (w+w). This arrangement allows conveyor capacity to be increased at the loading shovel where needed while still meeting space limitations along other points of the mining machine frame.

Further, it should also be appreciated that all constrictions and bottlenecks are eliminated by the strategic placement of the conveyor drive system at the rear of the machine and the elimination of the gathering arms and related drive mechanism as utilized on continuous miners of conventional design. Thus, the conveyor pathway has a minimum throat opening area of substantially 10 $ft^2$ with a minimum clearance height between the boom and the floor pan of the loading shovel of substantially 12 inches. This is a remarkable minimum throat opening area and clearance in a mining machine with an overall height of no greater than 50 inches and more preferably 48 inches. As a result, a heretofore unachieved conveying capacity is provided in a miner capable of operating in relatively thin seams.

Further, it should be appreciated that the greater space or flow volume available for the movement of aggregate material both into and along the twin chain flight conveyor may be provided even while larger drive motors and gear cases are provided. These furnish increased horsepower to the drum for cutting aggregate material from the mineral seam. Further, these advantages may be provided while still maintaining an overall low profile for operation in relatively thin seams.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing:

FIG. 2 is a side elevational view of the mining machine shown in. FIG. 1;

Reference will now be made in detail to the present preferred embodiment of the invention, an example of which is illustrated in the accompanying drawing.

DETAILED DESCRIPTION OF THE INVENTION

Reference is now made to FIGS. 1–6 showing the mining machine 10 of the present invention for the continuous mining of a mineral seam. Such a mining machine may be utilized in a highwall mining system of the type described in, for example, U.S. Pat. Nos. 5,112,111 and 5,261,729 to Addington et al. owned by the assignee of the present invention. The full disclosure presented in these patent documents is incorporated herein by reference.

Advantageously, highwall mining systems of the type described allow for operation in thin seams to a depth of substantially 5–10 times greater than that possible with conventional auger mining. Since a large percentage of the remaining coal reserves around the world exists in relatively thin seams too low to mine with current underground methods and so situated to make surface mining impractical, highwall mining is expected to move to the forefront of coal recovery methods in the future.

Figure 1:
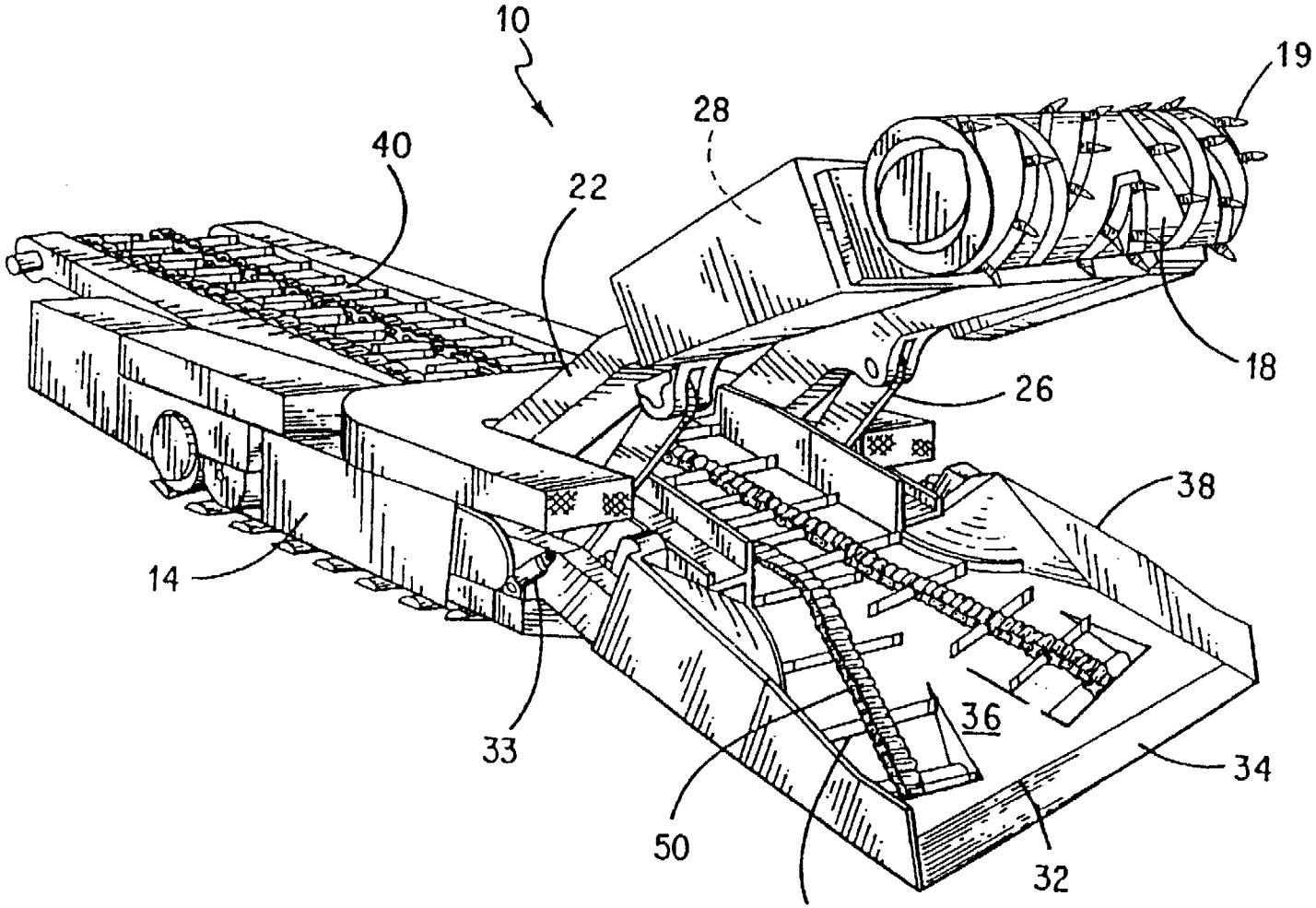
FIG. 1 is a perspective view of the mining machine of the present invention.
Figure 3:
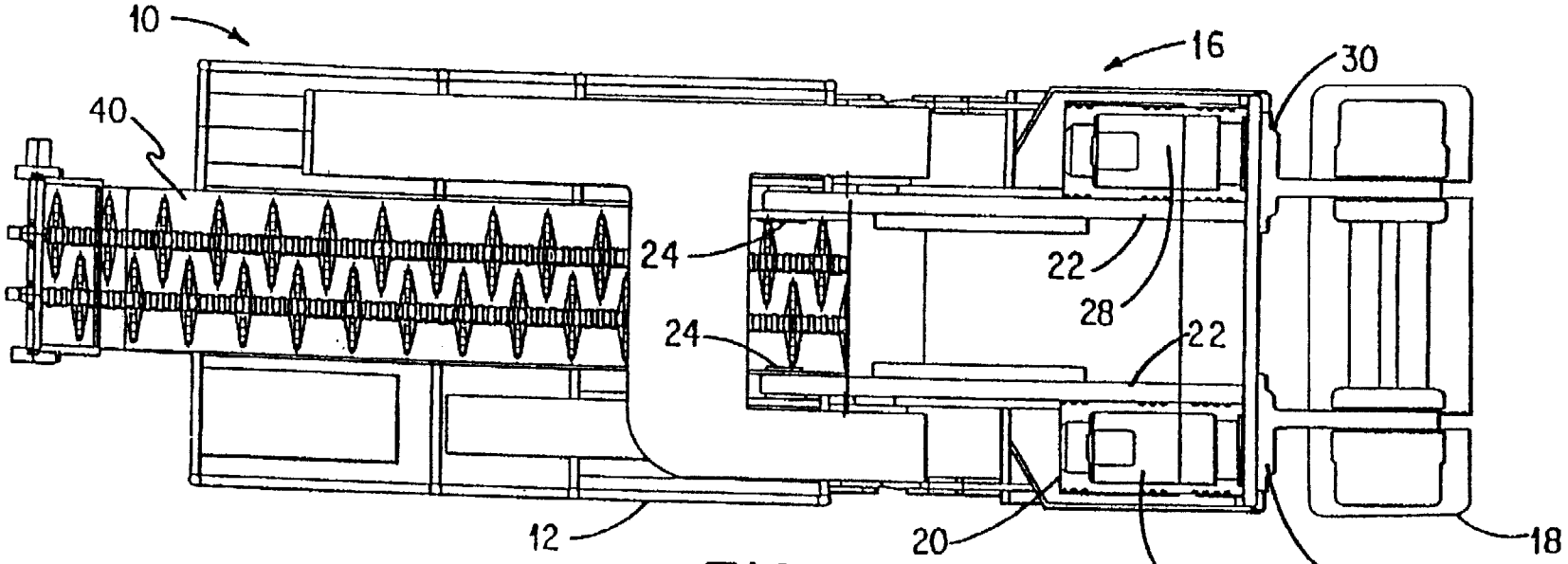
FIG. 3 is a top plan view of the mining machine.
Figure 2:
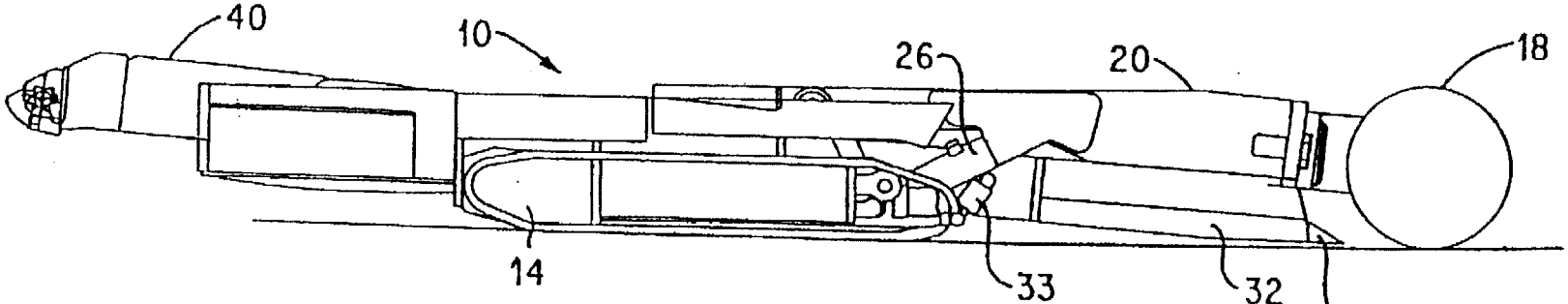

As best shown in FIGS. 1, 2 and 3 the mining machine 10 includes a main frame 12 supported for moving or propelling relative to the ground by means of a pair of crawler assemblies 14, one on each side of the mining machine. These crawler assemblies 14 are powered by electric or hydraulic motors (not shown) carried on the frame 12 in a manner well known in the art.

The mining machine 10 also includes a means, generally designated by reference numeral 16, for winning aggregate material from the mineral seam. More particularly, the winning means comprises a three piece rotary cutter drum assembly 18 carried on the forward end of a boom 20 that is pivotally mounted to the frame 12. More specifically, as known in the art the cutter drum assembly 18 includes a series of picks 19 for ripping, breaking or cutting aggregate material from the mineral seam for subsequent recovery. As shown, the cutter drum assembly 18 is substantially cylindrical in shape. It should be appreciated, however, that other shaped drum assemblies may be utilized (e.g. barrel shaped with a bulging midline tapering toward the opposing ends).

The boom 20 includes a pair of spaced, lateral arms 22, each arm being pivotally mounted to the frame 12 through a trunnion 24. A pair of hydraulic actuators 26 (only one shown in the Figures) allow the selective angular positioning of the boom 20 relative to the frame 12. One actuator 26 is operatively connected between the frame 12 and each of the boom arms 22. As should also be appreciated, one motor 28 and cooperating gear case 30 are carried by each arm 22 to drive the cutter drum assembly 18. Accordingly, it should be appreciated that the cutter drum assembly 18 being described is of conventional design and operates in a conventional manner well known in the art.

Figure 4:
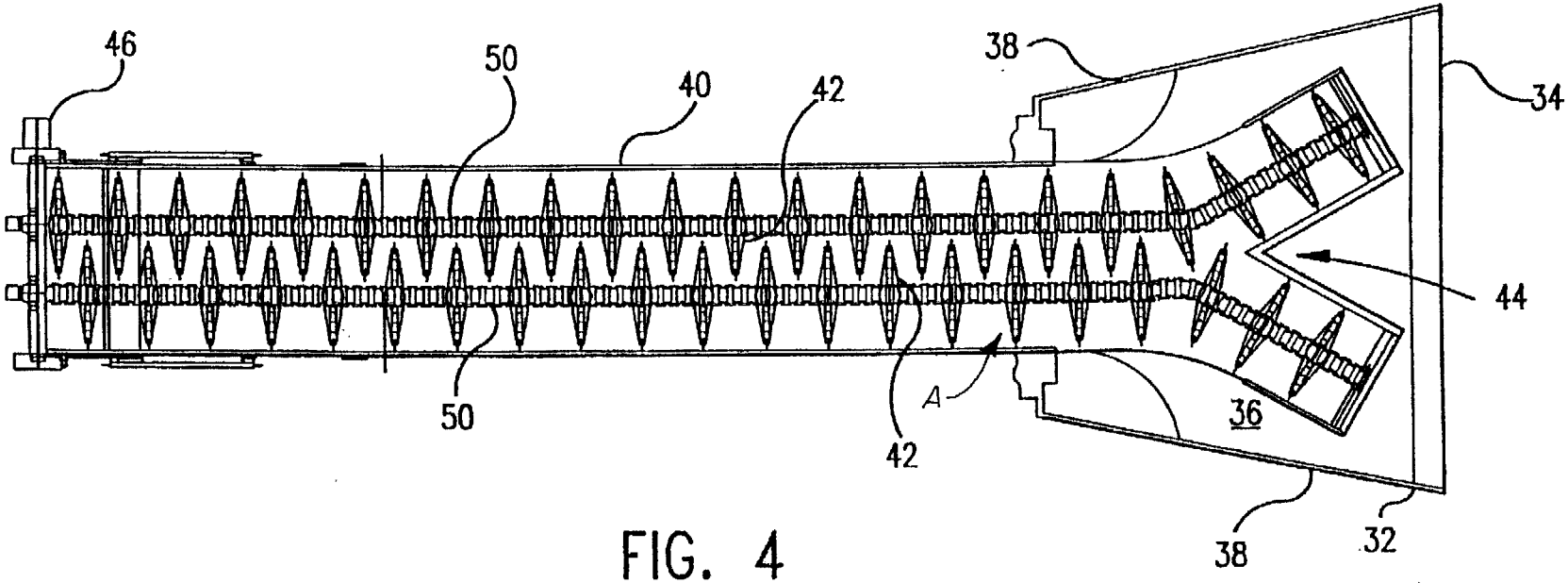
FIG. 4 is a detailed top plan view of the loading shovel and twin chain conveyor mechanism of the mining machine.
Figure 5:
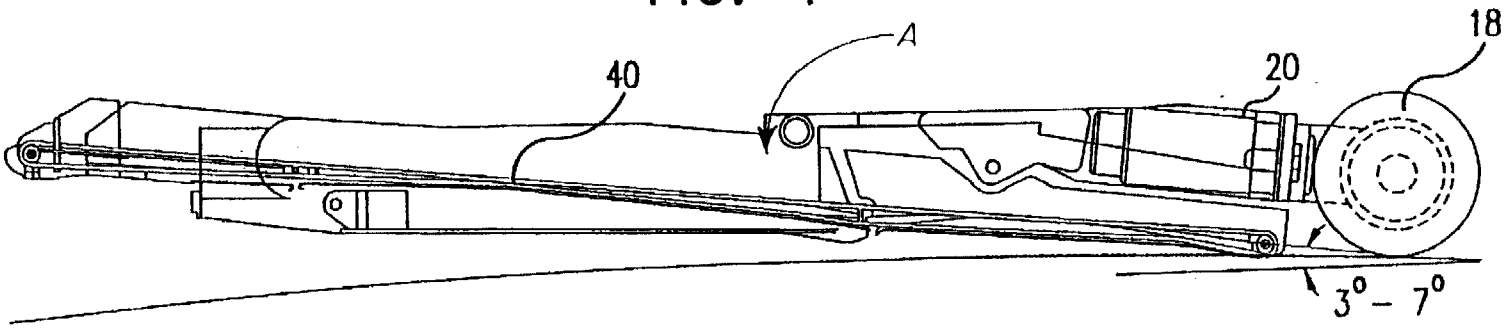
FIG. 5 is a schematical view along the centerline of the mining machine showing the substantially constant acclivity of the twin chain flight conveyor at an inclination angle of between 3°–7°.

As best shown in FIGS. 3–5, a loading shovel 32 is pivotally mounted to the front of the frame 12 so as to extend in a forward direction immediately below the boom 20 and below and behind the cutter drum assembly 18. The orientation of the loading shovel relative to the frame 12 is controlled by a pair of hydraulic actuators 33 mounted on the frame 12 (only one shown in the drawing figures). One actuator 33 is operatively connected to each side of the loading shovel 32.

The loading shovel 32 includes an inclined, reinforced front lip 34, a floor pan 36 and a pair of cooperating sidewalls 38 that form a scoop. As shown in FIGS. 1 and 4, a rear section of the sidewalls 38 converge toward a twin chain conveyor 40 as they extend in a rearward direction. As best shown in FIGS. 3 and 4, the twin chain conveyor 40 may include a series of interdigitating flights 42. As will be described in greater detail below, the interdigitating flight conveyor 40 includes relatively larger flights that convey aggregate material from a larger surface area of the loading shovel 32 thereby reducing aggregate material residence time in the shovel and increasing carrying capacity of the conveyor. It should be recognized, however, that conveyors of other design including aligned flights could also be utilized. The particular design of the conveyor 40 utilized is simply a matter of determining which design has characteristics meeting the needs of the mine operator.

Figure 6:
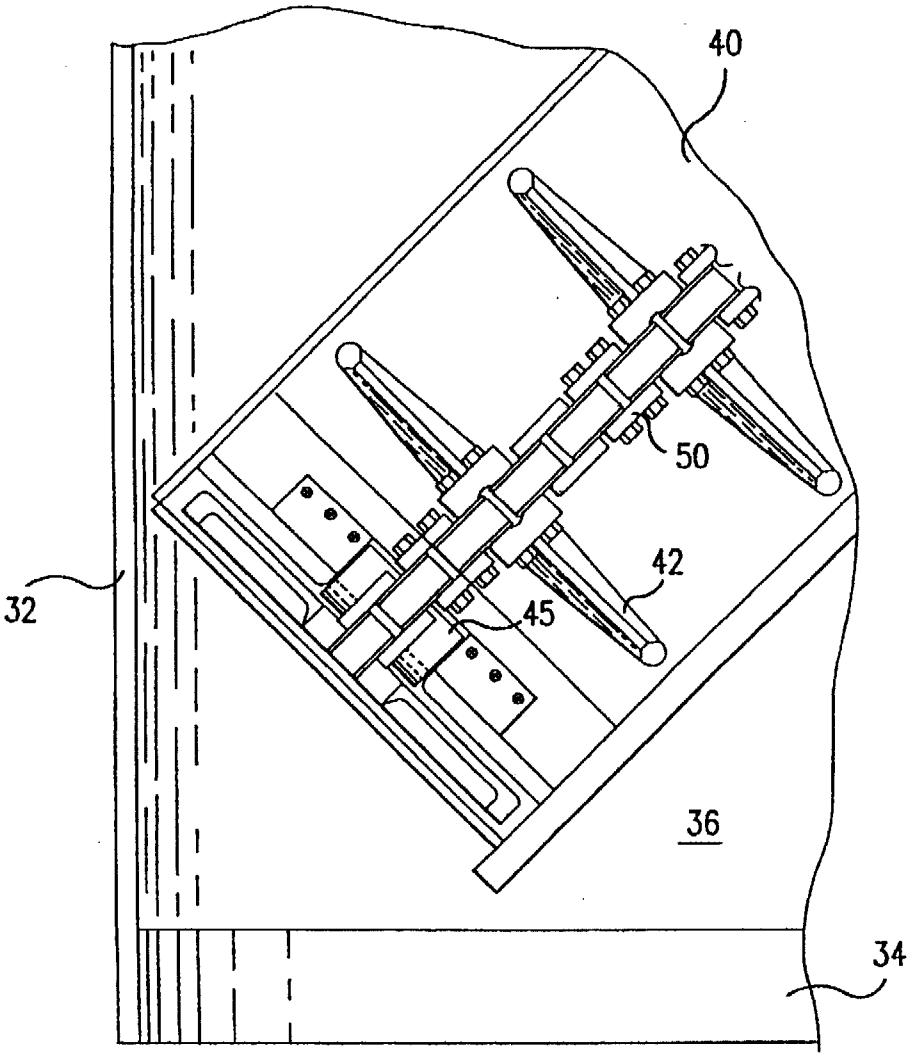
FIG. 6 is a partially sectional schematic view showing the spacial relationship of the front lip of the loading shovel and the reversing roller of the conveyor.

A forked section 44 with a deviation-from-centerline angle of between substantially 1°–60° and more preferably 20°–40° is provided at the forwardmost end of the conveyor 40 so that the conveyor extends toward the outer corners of the loading shovel 32 (see FIG. 6). In fact, by utilizing a relatively small diameter (e.g. 4 inches) reversing roller 45 at the forwardmost end of each leg of the forked section 44 of the conveyor 40 it is possible to position the conveyor flights 42 to sweep within substantially 5 inches and, more preferably, substantially 3 inches of the front lip 34 and sidewalls 38 of the loading shovel 32. Further, the front lip 34 preferably provides a rise of approximately 7 inches so that the aggregate material carrying surface thereof extends at a tangent to the reversing roller 45. This structural arrangement insures prompt and efficient loading of the conveyor 40 thereby minimizing the residence time of the aggregate material in the loading shovel 32.

In accordance with another important aspect of the present invention it should be appreciated that the cut aggregate material is conveyed rearwardly from the loading shovel 32 to the rear end of the frame 12 on the conveyor 40 in a continuous and uninterrupted manner. As best shown in FIG. 5, when the loading shovel 32 is in the scoop position for loading aggregate material from the mine floor, the conveyor 40 extends rearwardly along a pathway of substantially constant acclivity without any humps or dips to interfere with the efficient conveyance of the aggregate material. Preferably, the acclivity follows an inclination angle of between substantially 3°–7° and more preferably substantially 5°. Such a slope or grade allows efficient conveyance without significant spillage over the flights and undesired breakage of the aggregate material. Further, as a result of the present design, greater space or flow volume is available for the movement of material both into and along the conveyor 40. This is accomplished in at least four ways.

First, the hydraulic or electric drive motor 46 is provided at the rear or discharge end of the conveyor 40 opposite the loading shovel 32 where space is readily available to accommodate drive components. Further, the drive components are less likely to be contaminated with water and mud when housed in this position away from the mine floor. Still further, by driving at the discharge end, the motor 46 pulls the chains 50 from the load side thereby providing maximum operating efficiency and chain service life. As a further result, it is only necessary to provide sufficient space in the loading shovel for the relatively small return or reversing roller 45 for each of the chains 50 of the conveyor 40. This results in significant space savings in the loading shovel 32 and increases the open space for movement of the aggregate material.

Second, the relatively low profile of the reversing roller 45 noted above allows the receiving end of the conveyor 40 to be extended nearly to the lip 34 of the loading shovel 32. In effect, the conveyor 40 is made self-loading and there is no need to provide gathering arms or centripetal/centrifugal loading arms for moving coal into the conveyor 40 in accordance with continuous miners of conventional design. Through the elimination of the gathering arms and their associated gearing and drive motors from the area of the loading shovel 32, clearance for those mechanical components is no longer required and, accordingly, the pan may be lower in overall height and present a relatively low angle of rise (e.g. 3°–7°). This reduces the work necessary to push the aggregate material into the conveyor 40. Further, it allows a minimum clearance of 12 inches to be maintained between the floor pan 36 and boom 20 to furnish unimpeded conveyance of the aggregate material. Such large clearance is noteworthy in a mining machine with an overall height of less than 50 inches and more preferably 48 inches.

Thirdly, greater open space is also provided for the flow of aggregate material which can then proceed unconstricted and uninterrupted in a far more efficient manner than possible in prior art equipment. In fact, the conveyor pathway opening has a minimum throat opening area of at least 10 $ft^2$ throughout the length of the conveyor 40. This is also noteworthy in a mining machine of less than 50 inches in height. Of course, the greater available space allows the individual flights 42 to be made both wider and deeper. Hence, the carrying capacity of the conveyor 40 is substantially increased over a conveyor on a conventionally designed machine of the same size that includes a gathering arm mechanism. As a result, conveyor efficiency/capacity is no longer limiting and mining productivity may also be increased.

Fourthly, the design of the conveyor 40 allows one to take full advantage of wider flights 42 and the added conveying capacity such flights provide in the critical loading zone on the loading shovel 32. This is done while still meeting space limitation requirements at other, rearward parts of the mining machine 10. More specifically, the flights 42 of width W (e.g. 30 inches) provide a conveying capacity flight width of (w+w) (e.g. 60 inches) along the forked section 44 of the conveyer 40 on the loading shovel 32. Rearwardly of the forked section 44, the flights 42 on the opposing chains 50 of the chain conveyor 40 are interdigitated. Thus, the overall width of the conveyor 40 may be reduced to less than (w+w) (e.g. perhaps 48 inches) in order to provide clearance to extend along a narrow pathway defined between other mining machine components such as traction motor housings. Accordingly, the conveyor 40 incorporated into the mining machine 10 of the present invention meets the seemingly conflicting concerns of providing enhanced conveyance capacity within limited space confines.

Other advantages also result from the forward placement of the conveyor 40 and the elimination of gathering arms. More specifically, actual aggregate material handling is reduced. This has the two-fold benefit of increasing the size consist of the aggregate product while reducing the production of fines that are a waste product of the coal cleaning process. Additionally, spillage is minimized. Spillage is a serious problem in conventional mining machines as the stirring action of the gathering arms results in a significant portion of the aggregate material being thrown from the gathering pan where it remains, unrecovered, on the mine floor.

In accordance with yet another important aspect of the present invention, it should be appreciated that the loading shovel 32 is of relatively low profile (note particularly FIG. 2). More specifically, the elimination of all haulage drive systems from the area of the loading shovel 32 reduces space and, therefore, height requirements necessary to accommodate the bulky components associated with such systems. Further, it should be appreciated that in a highwall mining process, one bore hole is cut between opposing sidewalls of the mineral seam. These seam walls cooperate with the loading shovel 32 and particularly the sidewalls 38 to direct cut aggregate material onto the conveyor 40. Of course, the presence of the mineral seam sidewalls means that the sidewalls 38 of the loading shovel 32 may also assume a relatively low profile.

Advantageously, the low profile of the loading shovel 32 allows the mining machine 10 to accommodate a boom 20 of an increased size or vertical dimension while still maintaining an overall height low or lower than possible with conventional mining equipment. Accordingly, the boom 20 may be outfitted with larger drive motors 28 and symmetrical gear cases 30 so as to provide more horsepower to the cutter drum assembly 18. As a result, aggregate material may be removed from the mineral seam at a faster rate. Advantageously, since the conveyor 40 also includes a receiving end adjacent the lip 34 for self-loading as well as deeper and wider flights 42, the faster cutting rate may also be accommodated by the conveyor system so that overall mining efficiency and therefore productivity is significantly enhanced.

Yet another advantage of the low profile loading shovel 32 is its ability to accommodate the operation of a straight or flat boom 20. More particularly, it is not necessary to provide a hump or arch in the boom 20 to provide the necessary clearance to lay over the loading shovel 32. Advantageously, the flat cutter boom 20 provides enhanced forward visibility through cameras (not shown) that allow for remote operation of the mining machine 10. Further, it should be appreciated that conventional miners incorporating arched or humped booms present an obstacle that may lead to the miner becoming trapped in the event of a roof fall. In contrast, the straight or flat boom 20 of the present mining machine 10 significantly reduces this possibility by eliminating the arch that otherwise serves as a catch point.

It should further be appreciated, that the elimination of all haulage drive systems from the loading shovel 32 significantly reduces the weight of the shovel. Accordingly, the frictional loading of the loading shovel 32 against the mine floor is significantly reduced as the miner sumps forward. Thus, again, it should be appreciated that improved operating efficiency is the beneficial result.

Still further, it should be appreciated that the low profile loading shovel 32 and the straight or flat boom 20 function in combination to provide all of these benefits while still further providing an overall lower profile mining machine 10 capable of operation in thinner seams. This is a significant advantage as most of the remaining coal reserves in the world today are in seams too thin to be mined by a conventional continuous miner.

In summary, numerous benefits result from employing the concepts of the present invention. The mining machine 10 of the present invention advantageously allows for the application of more powerful motors and stronger or higher rated gear boxes to power the cutter drum assembly 18 for the more efficient winning of aggregate material from the mineral seam. Increased conveyance capacity and efficiency is provided by moving the receiving end of the conveyor 40 forward so as to become self-loading, increasing the height and width of the conveyor flights 42 and removing bottlenecks and/or constrictions to flow. Together, the increased cutting capacity and increased conveying capacity compliment one another allowing the operator to receive the full benefits of the increases in performance.

The total elimination of the gathering arm mechanism also serves to significantly simplify the mechanical structure of the mining machine, reducing the necessary downtime to perform maintenance/service operations. Thus, production or operation time is increased so as to provide an overall improvement in mining productivity relative to conventional continuous mining machines. Additionally, all of these benefits are achieved while allowing operation in relatively thinner seams. Thus, it should be appreciated that the mining machine of this invention represents a significant advance in the art.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, while the present invention has been described with reference to utilization in a highwall mining system, it can also be utilized in underground mining. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with breadth to which they are fairly, legally and equitably entitled.

We claim:

1. A mining machine for continuous highwall mining of a mineral seam, comprising:

a frame;

a loading shovel mounted to extend forwardly from said frame;

a cutter for winning aggregate material from the mineral seam, said cutter extending above and forwardly of said loading shovel; and a twin chain flight conveyor driven by a single motor and carried by said frame for conveying won aggregate material rearwardly from said loading shovel to a discharge end, said mining machine being characterized by said conveyor following a pathway having a substantially constant acclivity with an inclination angle of between substantially 3°–7°.

2. The mining machine set forth in claim 1, wherein said twin chain flight conveyor includes a forked secton at a forwardmost end carried on said loading shovel.

3. The mining machine set forth in claim 2, wherein said forked section has a deviation-from-centerline angle of between substantially 1°–60°.

4. The mining machine set forth in claim 3, wherein each leg of said forked section of said twin chain flight conveyor extends adjacent a forward corner of said loading shovel within substantially 5 inches of a forward lip of said loading shovel and substantially 5 inches of a sidewall of said loading shovel.

5. The mining machine set forth in claim 3 wherein each leg of said forked section of said twin chain flight conveyor extends adjacent a forward corner of said loading shovel within substantially 3 inches of a forward lip of said loading shovel and substantially 5 inches of a sidewall of said loading shovel.

6. The mining machine set forth in claim 2 wherein flights carried on each chain of said twin chain conveyor have a width W and thereby provide a flight width conveying capacity along said forked section of (w+w).

7. The mining machine set forth in claim 6, wherein said flights carried on said chains of said twin chain conveyor are interdigitated along said pathway rearwardly of said forked section thereby providing an overall conveyor width of less than (w+w) .

8. A mining machine for continuous highwall mining of a mineral seam, comprising:

a frame;

a loading shovel mounted to extend forwardly from said frame;

a cutter for winning aggregate material from the mineral seam, said cutter extending above and forwardly of said loading shovel; and a conveyor for conveying won aggregate material rearwardly from said loading shovel to a discharge end, said mining machine being characterized by said conveyor following a pathway having a substantially constant acclivity with an inclination angle of between substantially 3°–7°, said conveyor pathway having a minimum throat opening area of 10 $ft^2$.

9. The mining machine set forth in claim 8, wherein said mining machine has a total height of less than 50 inches.

10. A mining machine for continuous highwall mining of a mineral seam, comprising:

a frame;

a loading shovel mounted to extend forwardly from said frame;

a cutter for winning aggregate material from the mineral seam, said cutter extending above and forwardly of said loading shovel; and a conveyor for conveying won aggregate material rearwardly from said loading shovel to a discharge end, said mining machine being characterized by said conveyor following a pathway having a substantially constant acclivity with an inclination angle of between substantially 3°–7°;

said mining machine further including a boom for supporting said cutter and said conveyor pathway providing a minimum clearance height between said boom and a floor pan of said loading shovel of substantially 12 inches.

11. The mining machine set forth in claim 10, wherein said mining machine has a total height of less than 50 inches.

12. A mining machine for continuous highwall mining of a mineral seam, comprising:

a frame;

a loading shovel mounted to extend forwardly from said frame;

a cutter for winning aggregate material from the mineral seam, said cutter extending above and forwardly of said loading shovel; and a twin chain flight conveyor driven by a single drive motor carried by said frame for conveying won aggregate material rearwardly from said loading shovel to a discharge end, said mining machine being characterized by said conveyor following a pathway having a substantially constant acclivity with an inclination angle of substantially 5°.

13. The mining machine set forth in claim 12, wherein said twin chain flight conveyor includes a forked section having a deviation-from-centerline angle of between substantially 1°–60°.

14. The mining machine set forth in claim 13, wherein each leg of said forked section of said twin chain flight conveyor extends adjacent a forward corner of said loading shovel within substantially 3 inches of a forward lip of said loading shovel and substantially 5 inches of a sidewall of said loading shovel.

15. The mining machine set forth in claim 14, wherein each leg of said forked section of said twin chain flight conveyor includes a reversing roller adjacent said front lip and sidewall of said loading shovel, said aggregate material carrying surface of said front lip extending at a tangent to said reversing roller.

16. A mining machine for continuous highwall mining of a mineral seam, comprising:

a frame;

a loading shovel mounted to extend forwardly from said frame;

a cutter for winning aggregate material from the mineral seam, said cutter extending above and forwardly of said loading shovel; and a twin chain flight conveyor driven by a single drive motor carried by said frame for conveying won aggregate material rearwardly from said loading shovel to a discharge end, said mining machine being characterized by said conveyor following a pathway opening having a minimum throat opening area of 10 $ft^2$.

17. The mining machine set forth in claim 16, wherein said twin chain flight conveyor includes a forked section at a forwardmost end carried on said loading shovel.

18. The mining machine set forth in claim 17, wherein said forked section has a deviation-from-centerline angle of between substantially 1°–60°.

19. The mining machine set forth in claim 18, wherein flights carried on each chain of said twin chain conveyor have a width W and thereby provide a flight width conveying capacity along said forked section of (w+w).

20. The mining machine set forth in claim 19, wherein said flights carried on said chains of said twin chain conveyor are interdigitated along said pathway rearwardly of said forked section thereby providing an overall conveyor width of less than (w+w).

* * * * *